US006170756B1

(12) United States Patent
Adkins et al.

(10) Patent No.: US 6,170,756 B1
(45) Date of Patent: Jan. 9, 2001

(54) GAUGE PLATE AND SWITCH ROD INSULATORS

(75) Inventors: Kevin R. Adkins, Wayne, WV (US); William T. Urmson, Jr., Valencia, PA (US); John S. Cooper, Irwin, PA (US); John W. Mospan, Pittsburgh, PA (US)

(73) Assignee: Portec Rail Products, Inc., Pittsburgh, PA (US)

( * ) Notice: Under 35 U.S.C. 154(b), the term of this patent shall be extended for 0 days.

(21) Appl. No.: 09/089,958

(22) Filed: Jun. 3, 1998

Related U.S. Application Data

(60) Provisional application No. 60/065,519, filed on Nov. 12, 1997.

(51) Int. Cl.[7] ..... E01B 11/00
(52) U.S. Cl. ..... 238/152; 238/151
(58) Field of Search ..... 238/152, 151

(56) References Cited

U.S. PATENT DOCUMENTS 1,096,469 5/1914 Steele .
3,201,046 * 8/1965 Ferguson ..... 238/152
4,391,425 7/1983 Keep, Jr. ..... 246/428

OTHER PUBLICATIONS

Portec Maintenance Products Division 6 pp.brochure entitled "Rail Joints–Insulated and Standard Rail Joints in Types for All installations", dated 1989.
"3M Insulating Railroad Products"—6 page Catalog (Date Unknown).

* cited by examiner

*Primary Examiner*—S. Joseph Morano
*Assistant Examiner*—Robert J. McCarry, Jr.
(74) *Attorney, Agent, or Firm*—Webb Ziesenheim Logsdon Orkin & Hanson, P.C.

(57) ABSTRACT

A T-shaped electrically insulated member for securing to rails having electric current passing therethrough. The electrically insulated rail member includes a metallic core and an electrically insulating material encasing the metallic core. The electrically insulated rail member can be used as a gauge plate or a switch plate. Bushings are received by the electrically insulated rail member for receipt of fasteners secured to adjacent rail members. Also disclosed is a method for manufacturing the electrically insulated rail member.

22 Claims, 4 Drawing Sheets

GAUGE PLATE AND SWITCH ROD INSULATORS

CROSS REFERENCE TO RELATED APPLICATION

This application claims the benefit of United States Provisional Patent Application Ser. No. 60/065,519, filed Nov. 12, 1997.

BACKGROUND OF THE INVENTION

1. Field of the Invention

The present invention relates to an insulating joint for use in a rail system to electrically isolate parts of the rail system from each other.

2. Description of the Prior Art

A rail system is generally divided into sections or blocks to be able to detect trains which permits more trains to travel on one stretch of track or rail. Each section is electrically isolated from all other sections so that when no train is present in the section, a high electrical resistance can be measured over the parallel railbars in the section. When a train enters a section, the train short circuits adjacent railbars and the electrical resistance drops.

Railbars are generally welded to each other or attached to each other by a steel joint. High performance non-metallic joints are used for electrically isolating two railbars in order to build an electrically isolated section. Switches are insulated in the same way by dividing both gauge plate and switch rods into two parts and by joining the respective parts with a non-metallic joint.

Known non-metallic joints are very expensive because of the special high performance material which has to endure high tensile and flexural forces. One such non-metallic material used for the joints is a laminated SCOTCHPLY® material manufactured by 3M of St. Paul, Minn. In addition, a separate insulating plug must be utilized between ends of the gauge plate or switch rod to prevent material buildup of debris which would then cause an electrical short.

An object of the present invention is to provide an insulating joint whereby the above drawbacks are eliminated.

SUMMARY OF THE INVENTION

According to the present invention, an insulating joint is provided, including a metallic core body having at least one hole formed in the body and a first insulating layer covering the outer surface of the body. A second insulating layer can be arranged in the holes. Preferably, the insulating layer is made of polyurethane. Alternatively, a rubber layer can be used.

An advantage of the present invention is that it is less expensive to manufacture than the prior art SCOTCHPLY® arrangements.

A preferred embodiment of the present invention further includes bushings in the holes to account for pressure forces exerted by the bolts used for joining, for example, two switch rods or gauge rods.

Preferably, a second insulating layer is arranged on an outer surface of the bushing. This will enable the simple exchange of new bushings when the bushing or the second insulating layer becomes worn.

Preferably, the insulating joint is T-shaped, wherein the core is likewise T-shaped. The core includes a flat base and a ridge or leg depending from the base. The T-shaped core is covered with the insulating layer.

Further, the present invention is an electrically insulated rail member to be secured to rails having an electric current passing through the rails that includes a metallic core and an electrically insulating material encasing the metallic core. The metallic core can be flat or T-shaped. Further, the metallic core can be made of steel. The electrically insulating material can be molded about the metallic core. The T-shaped cross section is defined by a flat body and a depending leg. The metallic core can be flat and the depending leg can be completely defined by the electrically insulating material. The present invention can be used as a switch plate or a gauge plate.

The metallic core encased with the electrically insulating material defines a body having a hole adapted to receive a fastener for securing the electrically insulated rail member to an adjacent metallic member for maintaining a gauge of two adjacent rails, wherein the fasteners are electrically insulated from the metallic core. A plurality of holes can be defined in the body for receiving fasteners for maintaining a gauge of two adjacent rails, wherein the fasteners are electrically insulated from the metallic core.

The present invention is an arrangement for maintaining the gauge between a first rail and a second rail to form a track having a current passing therethrough and includes a first member extending from the first rail toward the second rail, a second member extending from the second rail toward the first rail and a gauge plate secured to the first member and the second member. The gauge plate includes a metallic core and an electrically insulating material encasing the metallic core whereby the electrically insulating material electrically insulates the first member from the second member. The arrangement includes a gap defined between the first member and the second member, wherein the gauge plate further includes a body having a leg depending therefrom, wherein the leg is received within the gap.

The present invention is also an arrangement for coupling a first rail and a second rail to form a track having an electric current passing therethrough and includes a first member extending from the first rail toward the second rail and a second member extending from the second rail toward the first rail. A first plate is secured to the first member and the second member and includes a metallic core and an electrically insulating material encasing the metallic core. A second plate is provided having an electrically insulating material encasing a metallic core. The first plate and the second plate sandwich ends of the first member and the second member which are secured thereto. The first plate and the second plate can be T-shaped having legs depending therefrom which are received within a gap defined by the first member and the second member. The legs can abut against each other. Holes are defined in the first plate and the second plate that align with holes defined in the first member and the second member, respectively, and fasteners pass through the respective holes. The holes can be defined by bushings received by the plates.

The present invention is also a method for manufacturing a T-shaped electrically insulating plate for use in coupling two rails having electric current passing therethrough, comprising the steps of: providing a metallic core; and encasing the metallic core with an electrically insulating material and forming a T-shaped electrically insulating plate. The method can further include providing bushings in the plate for receipt of fasteners.

DESCRIPTION OF THE PREFERRED EMBODIMENTS

Figure 1:
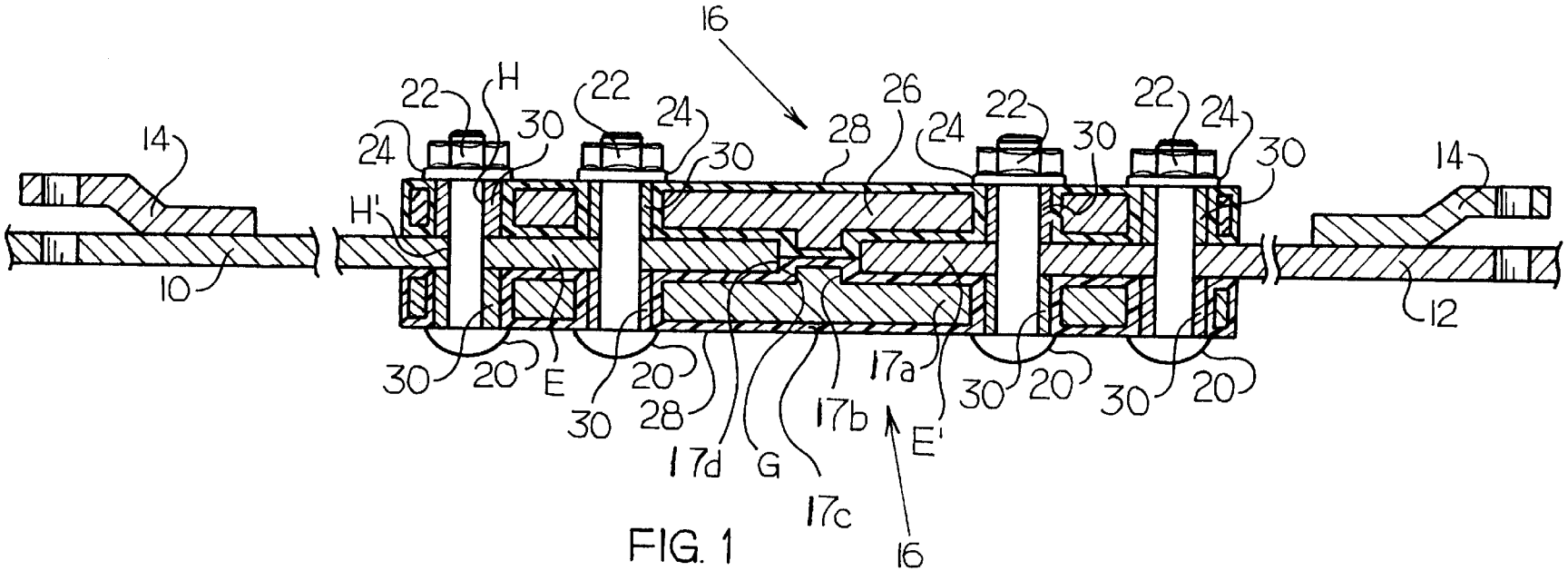
FIG. 1 is a sectional view of a first embodiment according to the present invention in a switch rod joint.

FIG. 1 shows a first embodiment according to the present invention used to connect a first part or first member 10 and a second part or second member 12 of a switch rod. The switch rod is attached by brackets 14 to the movable laterally spaced apart railbars of a switch which are used to maintain the gauge between movable railbars.

Figure 8:
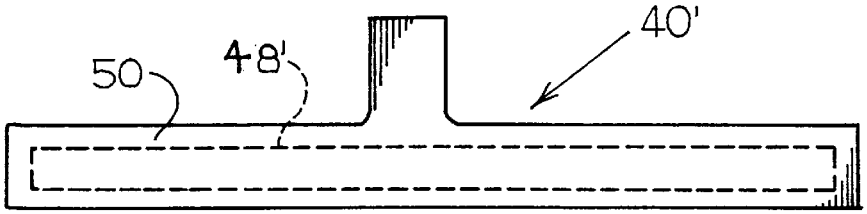
FIG. 8 is an elevational view of a gauge plate similar to that shown in FIG. 7 with a modified steel core.

Two parts 10 and 12 are connected to each other by two T-shaped insulating joints or switch plates 16 having T-shaped cross sections. Each insulating joint 16 includes a metallic core encased with an electrically insulating material. Each core is T-shaped with a flat body 17*a* having a leg or ridge 17*b* depending therefrom. Likewise, the insulating joint 16 includes a flat body 17*c* and a depending leg 17*d*. The depending leg 17*d* is received within a gap G defined between the first part 10 and the second part 12. Ends of the depending legs 17*d* abut against each other. Alternatively, it is believed that the metallic core can be a flat plate encased with an electrically insulating material replacing the depending leg or ridge 17*b* completely with insulating material as shown in FIG. 8. Alternatively, the insulating joints can be flat as opposed to T-shaped and an electric insulative filling can be provided between the insulating joints in the gap G defined by the opposed ends of the first part 10 and the second part 12 for electrically insulating these two parts 10 and 12 from each other. The insulating joints 16 are secured to the first part 10 and the second part 12 by a fastening arrangement of bolts 20, nuts 22 and washers 24.

Figure 2:
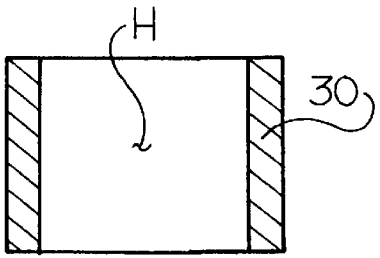
FIG. 2 is a sectional view of a bushing shown in FIG. 1.

More specifically, the insulating joint 16 includes a steel core 26 with a plurality of holes defined therein through which bolts 20 extend, an insulating layer 28 encasing the steel core 26 and a plurality of bushings 30 provided in the holes. FIG. 2 shows the bushings 30, which are electrically insulated from the steel core 26. Either the bushings 30 can have a separate bonded insulating layer or the insulating layer can be provided by the insulating layer 28.

The steel core 26, not the insulating layer 28, withstands tensile forces applied to the insulating joint 16 through parts 10 and 12. The bushings 30 protect the steel core 26 and the insulating layer 28 from wear caused by the bolts 20. As is evident, the installed T-shaped insulating joint 16 sandwiches ends E and E' of the two parts 10 and 12 and are secured thereto.

Figure 3:
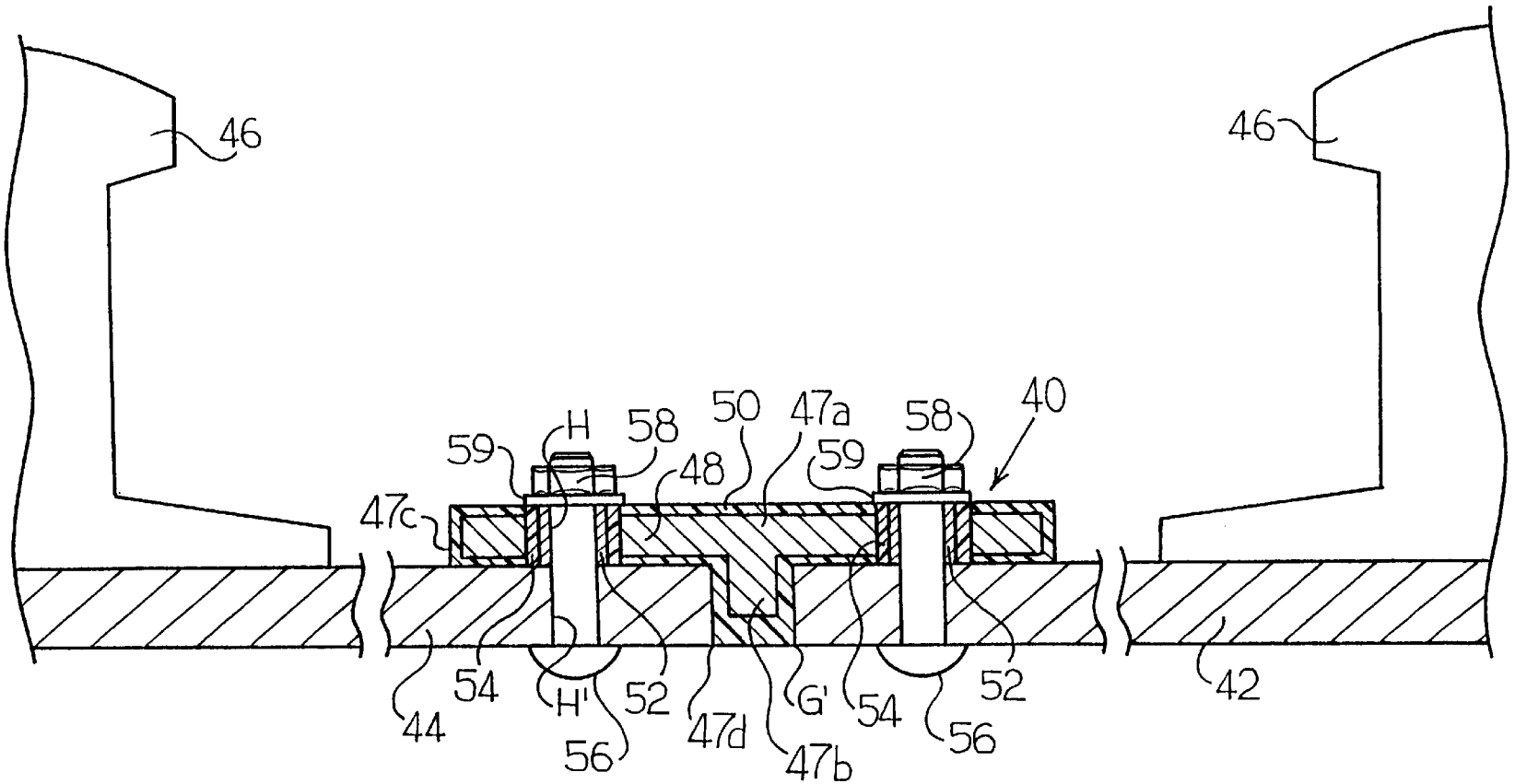
FIG. 3 is a sectional view of a second embodiment according to the present invention in a gauge plate joint.
Figure 6:
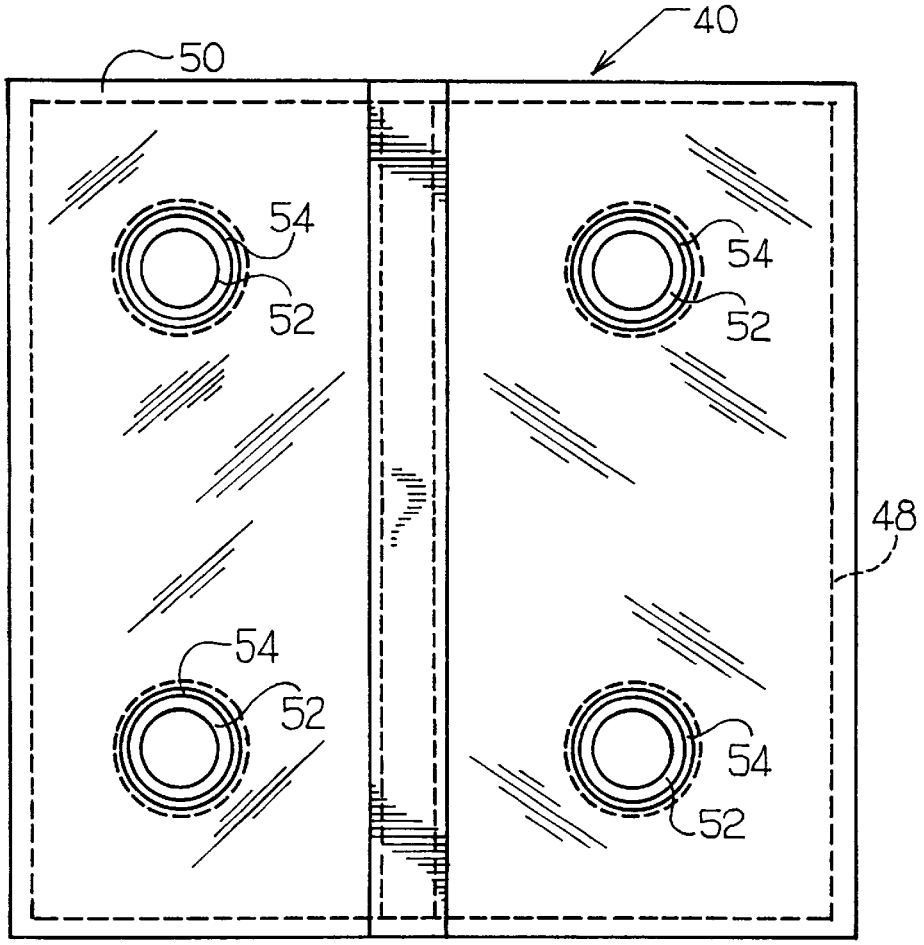
FIG. 6 is a top plan view of the gauge plate shown in FIG. 3.
Figure 7:
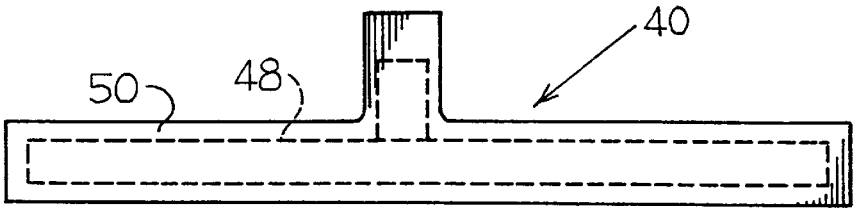
FIG. 7 is an elevational view of the gauge plate shown in FIG. 6.

FIGS. 3, 6 and 7 show a second embodiment according to the present invention of an insulating joint or gauge plate 40 for insulating a first part or first member 42 and a second part or second member 44 for maintaining the gauge of two rails 46 of a switch. The first part 42 and the second part 44 extend from respective laterally spaced apart rails 46.

Figure 4:
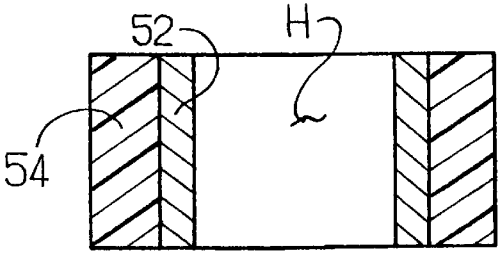
FIG. 4 is a sectional view of a bushing shown in FIG. 3.

The insulating joint or gauge plate 40 is T-shaped, i.e., has a T-shaped cross section, such that a part of the insulating joint 40 prevents the ends of the first part 42 and the second part 44 from making electrical contact. The insulating joint 40 includes a steel T-shaped core 48, a first electrically insulating layer 50, which encases the core 48, and steel bushings 52. As shown in FIG. 4, outer surfaces of each of the steel bushings 52 are covered with a second electrically insulating layer 54. The T-shaped core 78 of the insulating joint 40 likewise includes a flat body 47*a* and a depending leg 47*b*. The insulating joint 40 includes a flat body 47*c* and a depending leg 47*d*. The depending leg 47*d* is received within a gap G' between the first part 42 and the second part 44.

Bolts 56, nuts 58 and washers 59 secure the insulating joint 40 to the first part 42 and the second part 44.

An advantage of this second preferred embodiment is the T-shape of the joint which makes a separate insulating plug redundant. Because of this, the installation of the insulating joint 40 is easier than installing a joint of the prior art, and there is no need for a supplemental filling.

Another advantage is that the steel bushings 52 can be replaced whenever the steel bushings 52 or the second electrically insulating layer 54 are worn. In this manner, the dimensions of the hole defined in the core 48 will not vary due to wear.

FIG. 8 shows another embodiment of an insulating joint 40' made in accordance with the present invention that is similar to the insulating joint 40 shown in FIGS. 3, 6 and 7, where like reference numerals are used for like parts. The only difference between insulating joint 40' and insulating joint 40 is that the core 48 of insulating joint 40 is replaced with a flat plate core 48' of the insulating joint 40' and the "T" is formed totally by the first electrically insulating layer 50.

Figure 5:
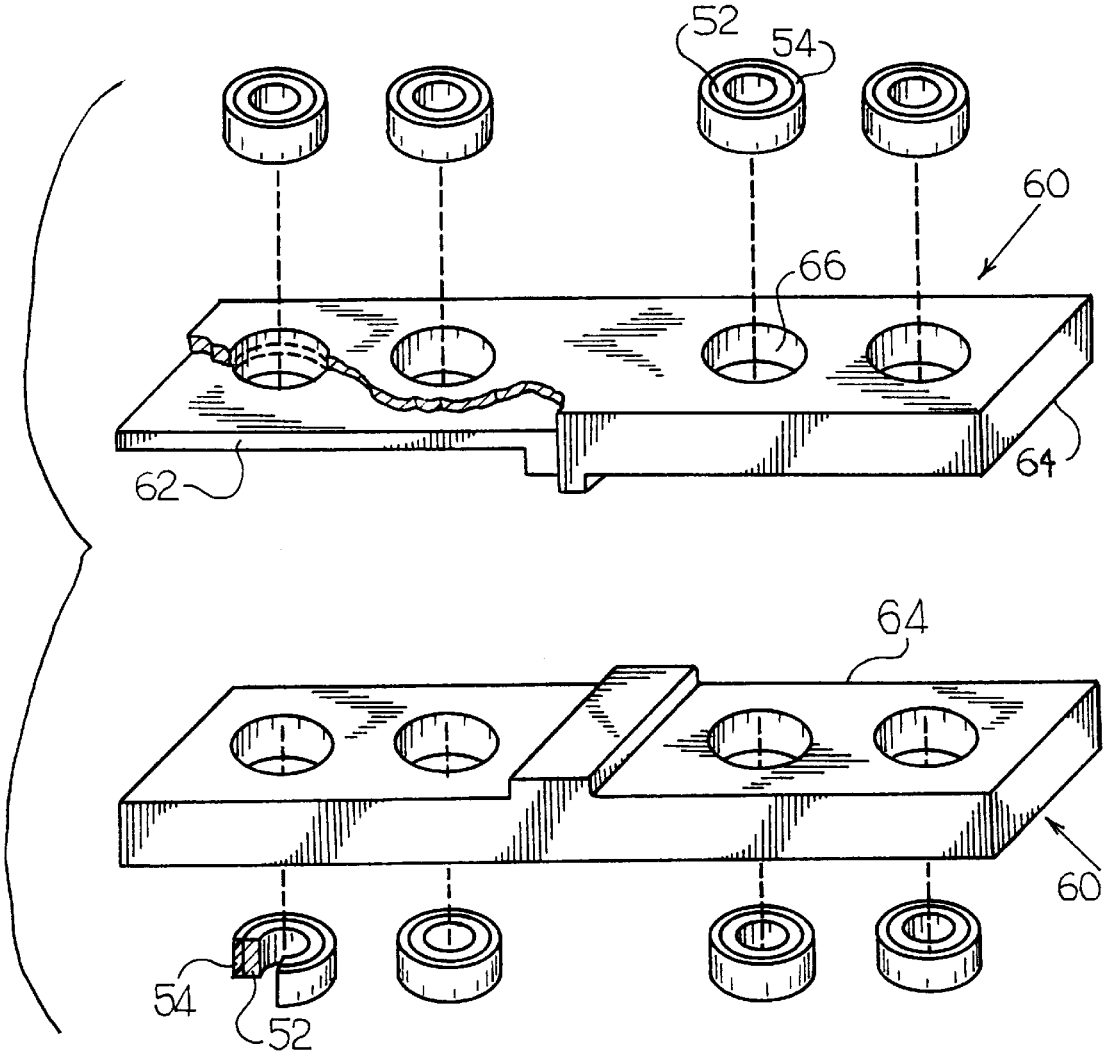
FIG. 5 is an exploded view, partially in section, of a third embodiment according to the present invention of a switch rod insulator plate.

FIG. 5 shows another preferred embodiment of an insulating joint 60 made in accordance with the present invention. This embodiment is similar to the insulating joint 16 described above and can be used in a switch rod in lieu of insulating joints 16.

The insulating joint 60 includes a T-shaped steel core 62, a first insulating layer 64 and the steel bushings 52 having a second electrically insulating layer 54 shown in FIG. 4. The insulating joint 60 is T-shaped such that, by mounting two insulating joints 60 on a switch rod, the insulating joints 60 abut and entirely fill the space between the two ends of the switch rod parts. Holes 66 are provided for receipt of the steel bushings 52, which are used to receive fasteners. Similar holes are provided in the other embodiments disclosed herein. As should be evident, the bushings 52 and 30 define holes H that align with respective holes H' defined in the first parts 10 and 42 and second parts 12 and 44 for receipt of the bolts 20 and 56, respectively, and the bolts 20 and 56 are electrically insulated from the respective metallic cores 26, 48 and 62.

All of the insulating joints are made by placing or providing the steel core in a mold and molding around the steel core electrically insulating material, such as polyurethane, rubber or other polymeric material, thereby forming a T-shaped electrically insulating plate. The metallic core can be flat or T-shaped. The bushings at that time can be cast in place. After the polyurethane hardens, the insulating rail joint is removed from the mold and if the bushings for receipt of fasteners, such as bolts 20 and 56, are not cast in place during molding, they can then be received by the insulating joint holes.

It will be understood by those of ordinary skill in the art that modifications may be made without departing from the spirit and scope of the present invention.

We claim:

1. An electrically insulated rail member to be secured to laterally spaced apart rails having an electric current passing through the rails, comprising:

a metallic core; and an electrically insulating material encasing said metallic core, wherein said metallic core and said electrically insulating material define a T-shaped electrically insulated member, and wherein said T-shaped electrically insulated member includes a T-shaped cross section defined by a flat body and a depending leg, and wherein the flat body defines at least one hole adapted to receive a fastener for securing said T-shaped electrically insulated rail member to an adjacent metallic member for maintaining a gauge of two laterally spaced adjacent rails, and wherein the fastener is electrically insulated from the metallic core.

2. An electrically insulated rail member to be secured to rails having an electric current passing through the rails as claimed in claim 1, wherein said metallic core comprises steel.

3. An electrically insulated rail member to be secured to rails having an electric current passing through the rails as claimed in claim 1, wherein said electrically insulating material is molded about said metallic core.

4. An electrically insulated rail member to be secured to rails having an electric current passing through the rails as claimed in claim 1, wherein said electrically insulating material is a polymeric material.

5. An electrically insulated rail member to be secured to rails having an electric current passing through the rails as claimed in claim 4, wherein said polymeric material is polyurethane.

6. An electrically insulated rail member to be secured to rails having an electric current passing through the rails as claimed in claim 1, wherein said metallic core encased with said electrically insulating material defines a body having a plurality of holes which is adapted to receive a plurality of fasteners through the holes for securing said electrically insulated rail member to two adjacent metallic members for maintaining a gauge of two adjacent rails, wherein the fasteners are electrically insulated from said metallic core.

7. An electrically insulated rail member to be secured to rails having an electric current passing through the rails as claimed in claim 1, further comprising a bushing received by the body defining the hole.

8. An electrically insulated rail member to be secured to rails having an electric current passing through the rails as claimed in claim 7, wherein said bushing is electrically insulated from said metallic core.

9. An electrically insulated rail member to be secured to rails having an electric current passing through the rails as claimed in claim 1, wherein said metallic member is flat and said depending leg is completely defined by said electrically insulating material.

10. An electrically insulated rail member to be secured to rails having an electric current passing through the rails as claimed in claim 1, wherein said metallic core encased with said electrically insulating material defines a body having a plurality of holes adapted to receive a plurality of fasteners for securing said electrically insulated rail member to two adjacent metallic members of a switching arrangement, wherein the fasteners are electrically insulated from the metallic core.

11. An arrangement for maintaining the gauge between a first rail and a laterally spaced second rail that form a track having electric current passing therethrough, comprising:

a first member extending from the first rail toward the second rail;

a second member extending from the second rail toward the first rail; and a gauge plate secured to said first member and said second member, comprising:

a metallic core; and electrically insulating material encasing said metallic core wherein said metallic core and said electrically insulating material define a T-shaped electrically insulated member, and wherein said T-shaped electrically insulated rail member includes a T-shaped cross section defined by a flat body and a depending leg, and wherein the flat body defines a plurality of holes receiving a plurality of fasteners for securing said T-shaped electrically insulated rail member to said first member and said second member for maintaining a gauge of said two laterally spaced adjacent rails, and wherein said fasteners are electrically insulated from the metallic core, whereby said electrically insulating material electrically insulates said first member from said second member.

12. An arrangement for maintaining the gauge between a first rail and a second rail that form a track having electric current passing therethrough as claimed in claim 11, wherein a gap is defined between said first member and said second member, said gauge plate leg received within the gap.

13. An arrangement for maintaining the gauge between a first rail and a second rail that form a track having electric current passing therethrough as claimed in claim 12, wherein said first member and said second member define holes that align with respective holes of said gauge plate and said fasteners passing through the aligned holes for securing said gauge plate to said first member and said second member.

14. An arrangement for maintaining the gauge between a first rail and a second rail that form a track having electric current passing therethrough as claimed in claim 13, wherein said gauge plate further comprises bushings received in said body, said bushings define the plurality of holes of said body.

15. An arrangement for coupling a first rail and a second rail that form a track having an electric current passing therethrough, comprising:

a first member extending from the first rail towards the second rail;

a second member extending from the second rail towards the first rail; and a first plate secured to said first member and said second member, comprising:

a metallic core; and an electrically insulating material encasing said metallic core, wherein said metallic core and said electrically insulating material define a T-shaped electrically insulated member, and wherein said T-shaped electrically insulated rail member includes a T-shaped cross section defined by a flat body and a depending leg, and wherein the flat body defines a plurality of holes receiving a plurality of fasteners for securing said T-shaped electrically insulated rail member to said first member and said second member, and wherein the fasteners are electrically insulated from the metallic core, whereby a lateral spacing of said first rail and said second rail is maintained by said first member, second member and said first plate.

16. An arrangement for coupling a first rail and a second rail that form a track having an electric current passing therethrough as claimed in claim 15, wherein said first plate is a gauge plate.

17. An arrangement for coupling a first rail and a second rail that form a track having an electric current passing therethrough as claimed in claim 15, wherein said first plate is a switch plate.

18. An arrangement for coupling a first rail and a second rail that form a track having an electric current passing therethrough as claimed in claim 15, wherein a gap is defined between said first member and said second member, said arrangement further comprising:

a second plate having a metallic core and an electrically insulating material encasing a metallic core, wherein said first plate and said second plate sandwich ends of said first member and said second member and are secured thereto.

19. An arrangement for coupling a first rail and a second rail that form a track having an electric current passing therethrough as claimed in claim 18, wherein each of said first plate and said second plate has a T-shaped cross section defined by a body and a leg depending therefrom, wherein said legs of said first plate and said second plate are received within the gap.

20. An arrangement for coupling a first rail and a second rail that form a track having an electric current passing therethrough as claimed in claim 19, wherein said legs of said first plate and said second plate have ends that abut against each other.

21. An arrangement for coupling a first rail and a second rail that form a track having an electric current passing therethrough as claimed in claim 18, wherein said first plate and said second plate define holes that align with holes defined in said first member and said second member and said arrangement further comprising fasteners passing through the aligned holes for securing said first member to said second member through said first plate and said second plate.

22. An arrangement for coupling a first rail and a second rail that form a track having an electric current passing therethrough as claimed in claim 21, further comprising a plurality of bushings received by said body, said bushings define the plurality of holes of said first plate and said second plate.

* * * * *

UNITED STATES PATENT AND TRADEMARK OFFICE

CERTIFICATE OF CORRECTION

PATENT NO. : 6,170,756 B1
DATED : January 9, 2001
INVENTOR(S) : Kevin R. Adkins et al.

It is certified that error appears in the above-identified patent and that said Letters Patent is hereby corrected as shown below:

Title page, Item [56],
Reference Cited , U.S PATENT DOCUMENTS, insert:

| | | | |
|---|---|---|---|
| -- | 394,309 | 12/1888 | Strom |
| | 401,312 | 4/1889 | Strom |
| | 712,132 | 10/1902 | Hall |
| | 891,532 | 6/1908 | Forder |
| | 1,421,447 | 7/1922 | Frinzi |
| | 1,671,276 | 5/1928 | Cowen |
| | 1,789,624 | 4/1929 | Gibbs, Jr. |
| | 2,035,929 | 3/1936 | Steward et al. --. |

Column 6, claim 11,
Line 8, before "electrically" insert -- an --.

Signed and Sealed this

Sixth Day of November, 2001

*Attest:*

Nicholas P. Godici

NICHOLAS P. GODICI
*Acting Director of the United States Patent and Trademark Office*

*Attesting Officer*